US005992024A

United States Patent [19]

Rogers

[11] Patent Number: 5,992,024

[45] Date of Patent: Nov. 30, 1999

[54] CLIPPINGS DIRECTING ATTACHMENT FOR COMPOSITE BOARD SHEARS

[76] Inventor: Michael W. Rogers, 61523 Brosterhouse Rd., Bend, Oreg. 97702

[21] Appl. No.: 09/258,660

[22] Filed: Feb. 26, 1999

Related U.S. Application Data

[63] Continuation-in-part of application No. 09/045,214, Mar. 20, 1998.

[51] Int. Cl.[6] ..... B26B 15/00

[52] U.S. Cl. ..... 30/228; 30/258

[58] Field of Search ..... 30/228, 258, 289, 30/233, 179

[56] References Cited

U.S. PATENT DOCUMENTS 2,934,822 5/1960 Docken ..... 30/228 X
4,173,069 11/1979 Sidenstick et al. ..... 30/228

*Primary Examiner*—Douglas D. Watts

[57] ABSTRACT

A clippings directing attachment for composite board shears that have a pair of blades defining a pair of parallel cutting planes by their mutually contacting surfaces and that create clippings when used to cut composite board. The attachment comprises a mounting assembly adapted to mount the attachment onto the shears and a chute attached to the mounting assembly and adapted to direct composite board clippings away from the cutting planes when the mounting member is mounted on the shears and the shears are being used to cut composite board.

12 Claims, 3 Drawing Sheets

CLIPPINGS DIRECTING ATTACHMENT FOR COMPOSITE BOARD SHEARS

This in a continuation-in-part of U.S. patent application Ser. No. 09/045,214 filed Mar. 20, 1998.

BACKGROUND OF THE INVENTION

The present invention relates to a clippings directing attachment for composite board shears.

The construction industry has made widespread use of composite board made of cellulose fiber and Portland cement in constructing house sidings. Hardie Plank®, a particular brand of composite board, is very widely used for this purpose.

Power shears are typically used to cut composite board. Shears are generally preferred over rotating saws because saws typically produce a great amount of dust, which interferes with the cutting operation. In particular, Snapper® brand shears, having two stationary blades, one on either side of an active blade, are a particularly widely accepted tool for cutting composite board. Sidenstick et al. U.S. Pat. No. 4,173,069 discloses this type of shears and is incorporated herein by reference.

A problem encountered when using power shears to cut composite board, however, is the production of clippings that loop back around in the cutting plane, blocking the vision of the operator. It is important for the operator to be able to view the cut line as he uses the shears. Consequently, a composite board shears operator typically spends a great deal of time pushing clippings away from his line of sight to the cut line.

BRIEF SUMMARY OF THE INVENTION

The present invention is a clippings directing attachment for composite board shears having a set of blades defining two parallel cutting planes by their mutually contacting surfaces. The attachment includes a mounting assembly adapted to mount the attachment onto the shears. A clippings directing member that is attached to the mounting assembly is adapted to direct composite board clippings away from the cutting planes when the mounting member is mounted on the shears and the shears are being used to cut composite board.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
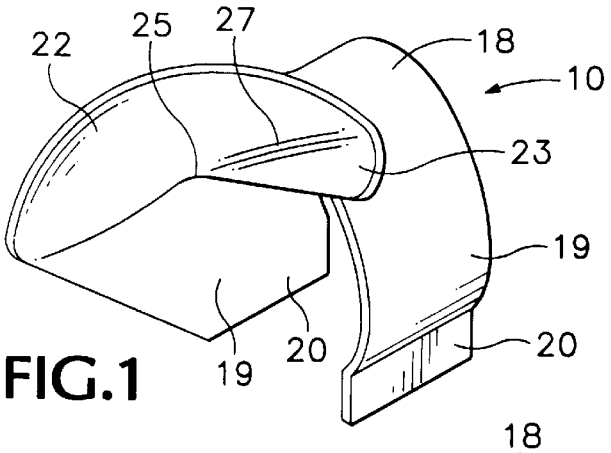
FIG. 1 is an isometric drawing of a composite board shears clipping directing attachment according to the present invention.
Figure 2:
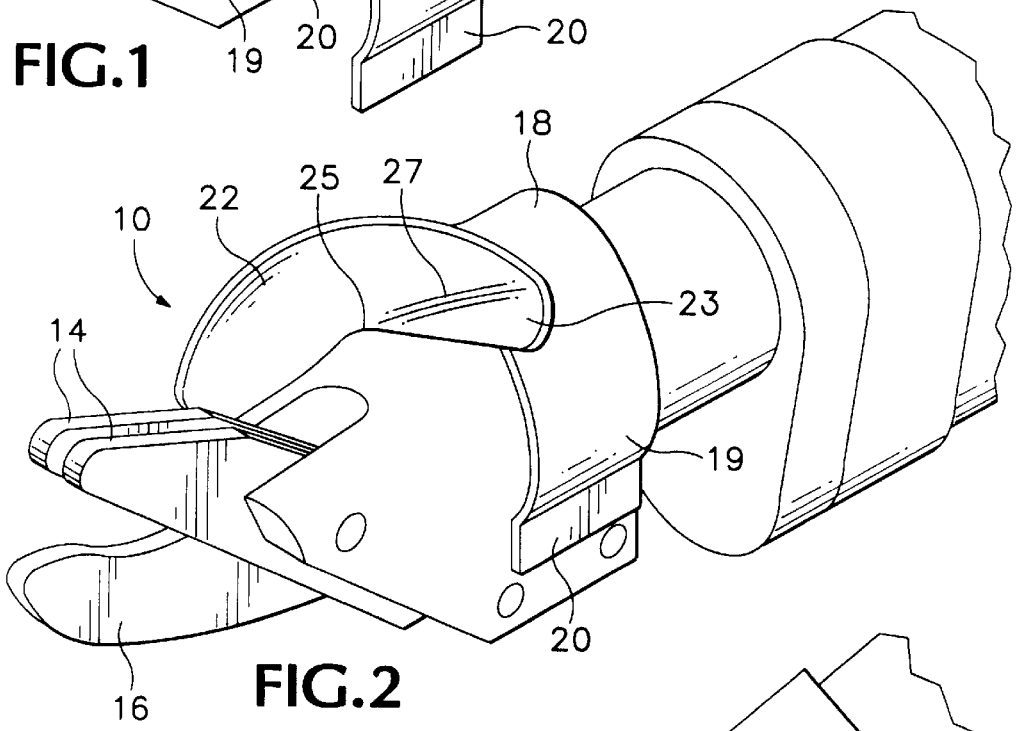
FIG. 2 is an isometric drawing of the attachment of FIG. 1, attached to a composite board power shears.

A clippings directing attachment 10 embodying the present invention is shown in FIG. 1, and is shown in FIG. 2 attached to a composite board power shears 12. Shears 12 have a set of blades that include a pair of top blades 14 and an active bottom center blade 16 that define a pair of parallel cutting planes at the interfaces between blade 16 and top blades 14. Blade 16 is driven in an up and down cutting motion by a drive assembly 17. When an operator uses composite board shears 12 without attachment 10 the cutting operation produces clippings that tend to loop back around in the parallel cutting planes, thereby blocking the view of the operator so that he is unable to see the prospective cut line through the composite board.

Figure 3:
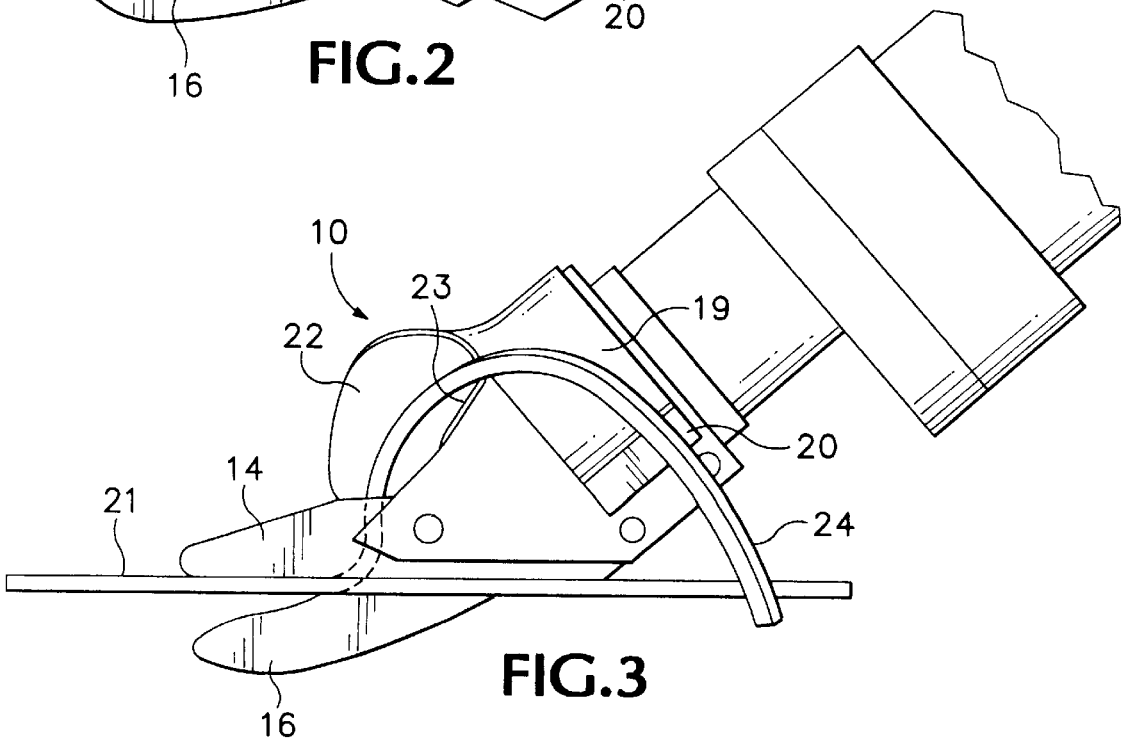
FIG. 3 is a side view of the attachment and shears of FIG. 2, being used to cut composite board.
Figure 4:
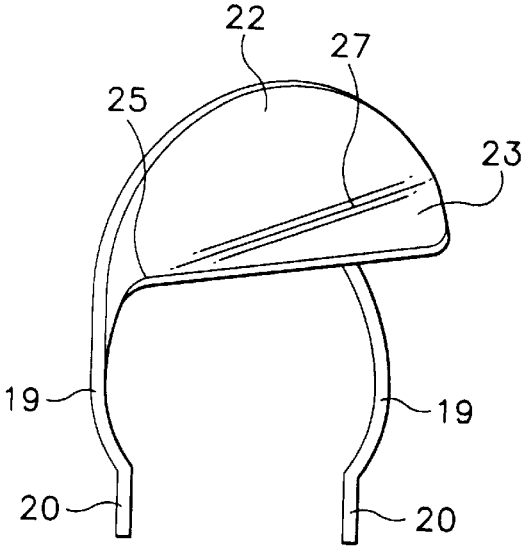
FIG. 4 is a front view of the attachment of FIG. 1.
Figure 5:
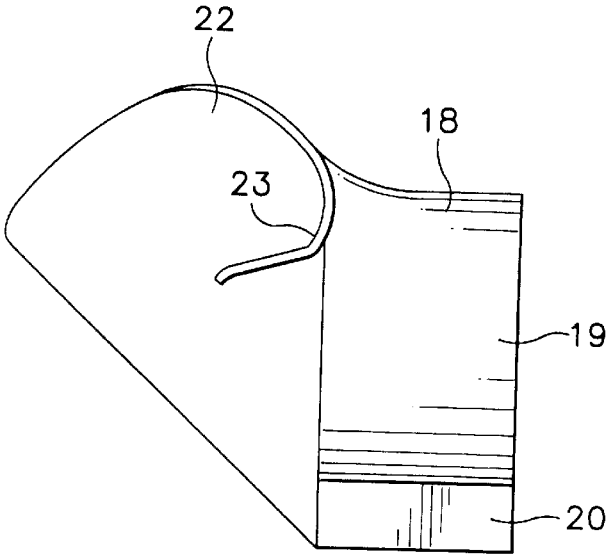
FIG. 5 is a side view of the attachment of FIG. 1.
Figure 6:
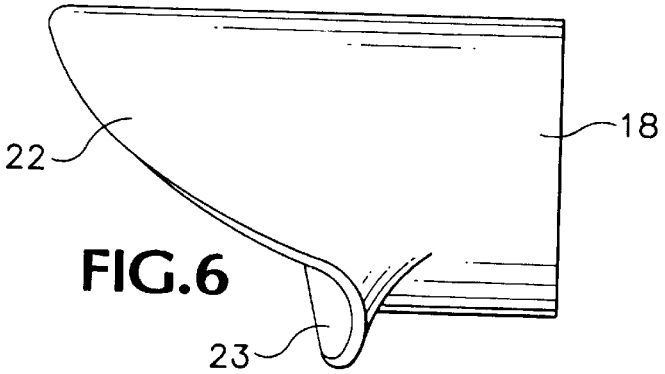
FIG. 6 is a top view of the attachment of FIG. 1.
Figures 7, 8, 9, 10:
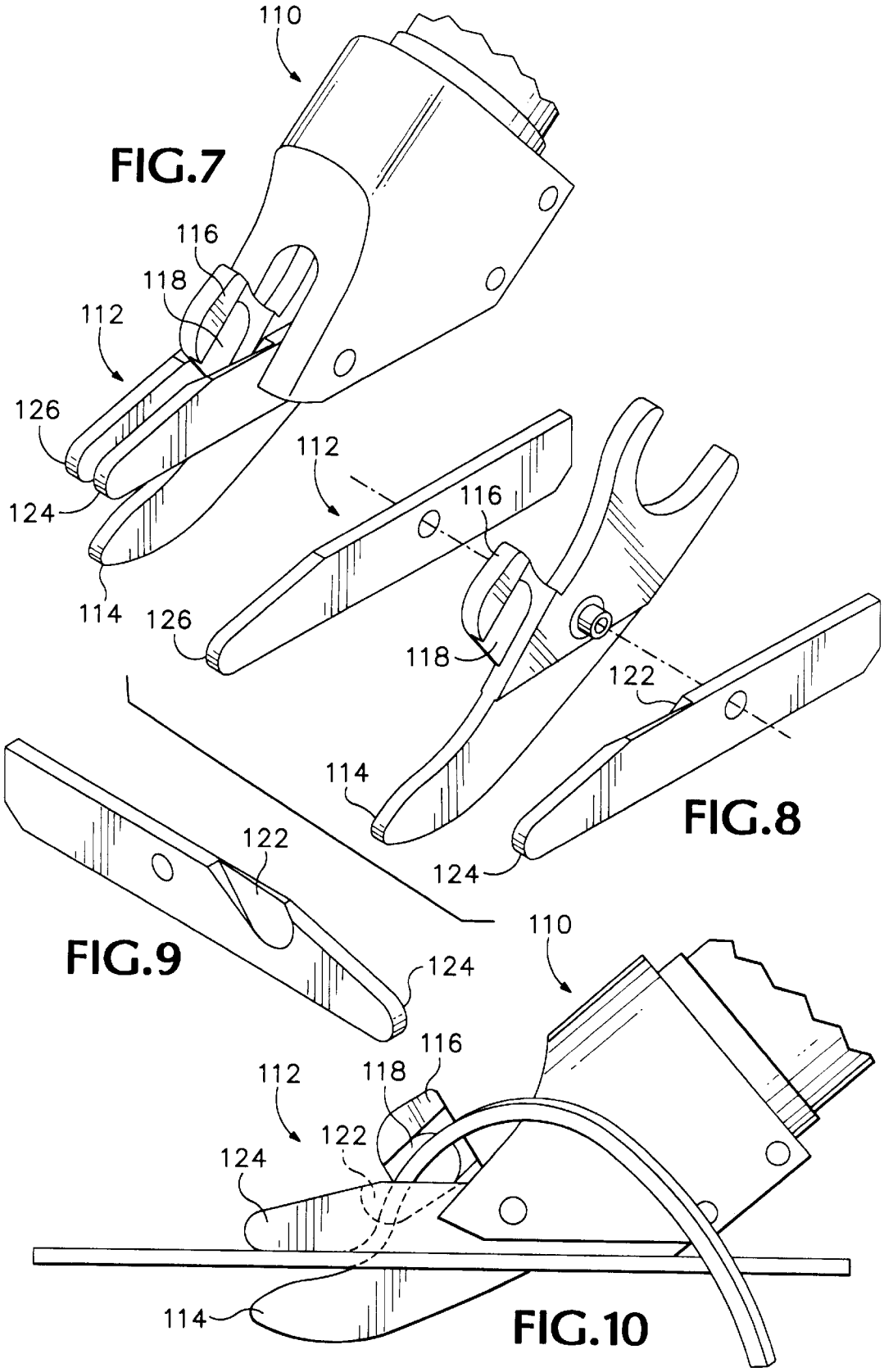
FIG. 7 is an isometric drawing of a composite board shears head equipped with a preferred embodiment of clippings directing blade set, according to the preferred present invention.
FIG. 8 is an expanded isometric drawing of the clippings directing blade set shown in FIG. 7.
FIG. 9 is an isometric drawing of a single blade of the clippings directing blade set of FIG. 7.
FIG. 10 is a side view of the composite board shears head equipped with the clippings directing blade set of FIG. 7, according to the preferred invention.

Attachment 10 includes a mounting 18 in the form of a saddle, for fastening the attachment 10 to drive assembly 17. More specifically, mounting 18 is composed of stiff, resilient material, such as plastic resin reinforced by glass fibers, in a sheet configuration, that is shaped to be retained on a forward portion of drive assembly 17 by pressing against it with bow-shaped sides 19 each terminating in a downwardly depending flange 20. When used to cut a composite board 21, a shield 22, and a chute 23 which may all be of similar material, redirect clippings 24 away from the cutting plane. As shown in the figures, shield 22 is an arcuate structure which projects forwardly into the natural path of travel of clippings 24 as they are cut free and pushed up by the center blade 16, as shown in FIG. 3, and deflects them towards chute 23. Chute 23 is in the form of a conical section having apex 25 and joining into shield 22 along boundary region 27, and directs the clippings 16 laterally away from the cutting planes, as illustrated.

Referring to FIGS. 7–10, a composite board shears 110 is equipped with a clippings directing set of blades 112. Central blade 114 has a upper extension 116, fashioned with a clippings directing chute 118, that shunts the clippings 120 to the side. A cooperative notch 122 in mating blade 124 is fashioned to accommodate the sideways directed clippings on the upstroke of central blade 114. In a preferred embodiment side blade 126 is also fashioned with a notch, such as notch 122, so that blades 124 and 126 may occasional be switched in position about central blade 114, for extending the wear life of blade set 112.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A clippings directing blade set for composite board shears, comprising:

(a) a central blade having two side faces;

(b) a first side blade and a second side blade placed to define and provide a cutting plane on either side face of said central blade and so situated that an up and down movement by said central blade relative to said side blades effects a cutting action said cutting planes being defined in the mathematical sense as extending infinitely in two dimensions; and (c) wherein said central blade includes a clippings directing extension adapted to receive clippings produced by said cutting action of said shears and direct said clippings away from said cutting planes.

2. The clippings directing blade set of claim 1 in which said first side blade defines a notch adapted to cooperate with said clippings directing extension in accommodating clippings being received by said clippings directing extension.

3. A clippings directing attachment for rigid material shears that have a set of blades defining two parallel cutting planes both extending infinitely in two directions by their mutually contacting surfaces and that create clippings when used to cut composite board, said attachment comprising:

(a) a mounting adapted to mount said attachment onto said shears; and (b) a clipping directing member attached to said mounting and adapted to direct composite board clippings away from said cutting planes when said mounting member is mounted on said shears and said shears are being used to cut rigid material.

4. The clippings directing attachment of claim 3 wherein said clippings directing member is in the form of a chute.

5. The clippings directing attachment of claim 3 wherein said mounting is composed of resilient material, has a pair of flanges and is shaped to be retained on a forward portion of said shears by said flanges pressing against said forward portion of said shears.

6. A method for facilitating the use of composite board shears having a set of blades that define a pair of parallel cutting planes, both extending infinitely in two dimensions, by their mutually contacting surfaces, comprising the steps of:

(a) providing a clippings directing attachment including:

(i) a mounting adapted to mount said attachment onto said shears; and (ii) a clippings directing member attached to said mounting assembly;

(b) mounting said mounting onto said shears;

(c) cutting rigid material with said shears, creating clippings; and (d) directing said clippings away from said cutting with said clippings directing member.

7. The method of claim 6 wherein said clippings directing member is in the form of a chute.

8. The method of claim 6 wherein said mounting is composed of resilient material, has a pair of flanges and is shaped to be retained on a forward portion of said shears by said flanges pressing against said forward portion of said shears.

9. A pair of composite board shears comprising:

(a) a drive assembly;

(b) a set of blades hinged together, defining a pair of parallel cutting planes, that both extend infinitely in two dimensions, by their mutually contacting surfaces and adapted to be driven in cutting motion by said motor and drive assembly; and (c) a clippings directing member attached to said drive assembly and adapted to direct composite board clippings away from said cutting plane when said shears are being used to cut composite board.

10. The composite board shears of claim 9 wherein said clippings directing member is in the form of a chute.

11. The rigid material shears of claim 9 wherein said clippings directing member is in the form of a chute.

12. The rigid material shears of claim 9 wherein said second portion is attached to said drive assembly.

* * * * *